US005597363A

United States Patent [19]

Leote

[11] Patent Number: 5,597,363

[45] Date of Patent: Jan. 28, 1997

[54] GOLFER'S ACCESSORY

[76] Inventor: Joseph A. Leote, 68 N. Pascack Rd., Nanuet, N.Y. 10954

[21] Appl. No.: 233,053

[22] Filed: Apr. 26, 1994

[51] Int. Cl.[6] ..... A63B 55/10; A63B 55/02

[52] U.S. Cl. ..... 473/282; 248/156

[58] Field of Search ..... 273/32 B; 473/282, 473/283, 284, 285, 286; 248/156, 85, 86

[56] References Cited

U.S. PATENT DOCUMENTS

| | | | |
|---|---|---|---|
| 4,545,579 | 10/1985 | McCain | 473/282 |
| 4,998,726 | 3/1991 | Budnick | 273/32 B X |
| 5,004,239 | 4/1991 | Wettstein | 273/32 B X |
| 5,149,087 | 9/1992 | Thompson | 273/32 B |
| 5,286,019 | 2/1994 | Watabe | 273/32 B |

FOREIGN PATENT DOCUMENTS

| | | | |
|---|---|---|---|
| 2073563 | 10/1981 | United Kingdom | 273/32 B |

OTHER PUBLICATIONS

Par 3 Enterprises, "Caddy II" Sales Sheets, (No Publication Date), 2 pages color, trade literature.

Jef World of Golf, "Putter Prop" Packaging, (No Publication Date), 1 page color, trade literature.

*Primary Examiner*—George J. Marlo

[57] ABSTRACT

A shaft having insert portion disposed at a bottom end of the shaft and having rotatable handle assembly disposed at a top end of the shaft. An insert guard optionally spring mounted to protect and cover the end of insert portion when the club supporter is being stored in golf bag, or is otherwise not in operation. Rotatable handle assembly preferably includes a plastic cylindrically-shaped handle rotatably mounted to shaft on pivot member. Handle may be shaped to form a recess, clip, or receptacle, or a plurality of recesses, for receiving a portion of a golf club shaft allowing the golf club to be supported when the club supporter is operatively inserted in the ground.

A towel cover is provided of water-resistant material adapted to form a shaped cover and includes a frame or rack for securing a towel within the cover. Mounting and closure equipment are optionally provided for attaching the cover to objects and for providing access to the region disposed within the cover, respectively. A divider isolates regions within the cover, so that soiled and clean towel compartments are provided.

4 Claims, 1 Drawing Sheet

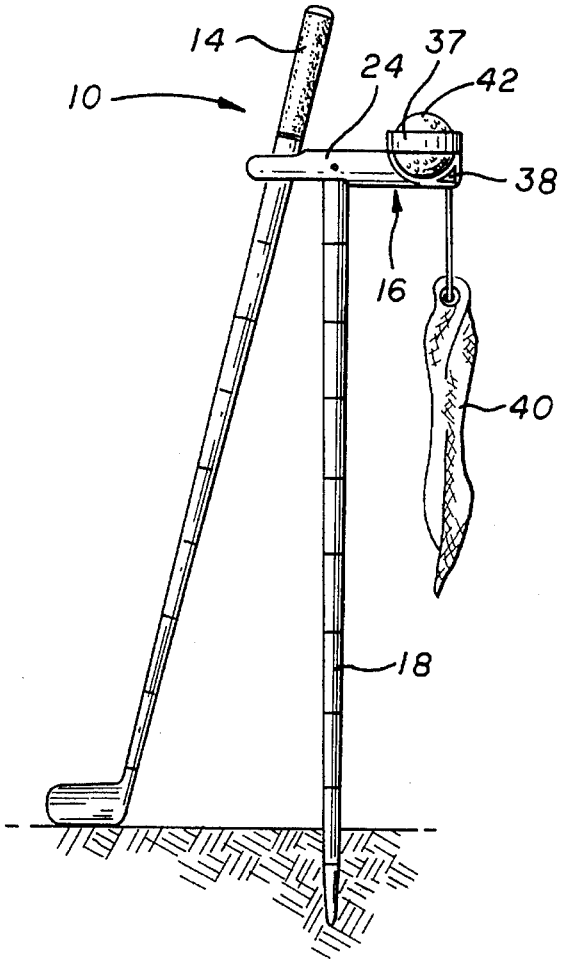
FIG. 1
FIG. 2
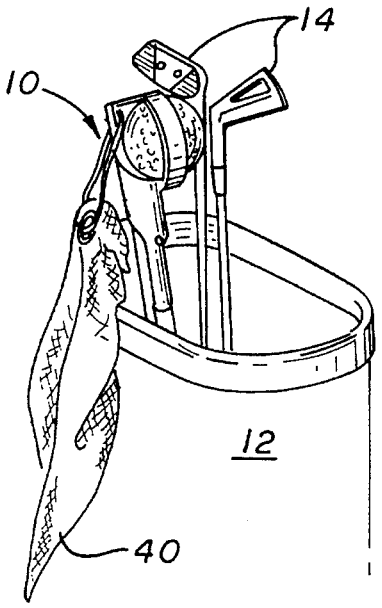
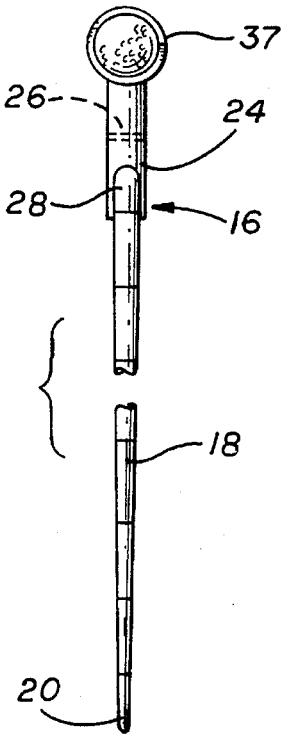
FIG. 3
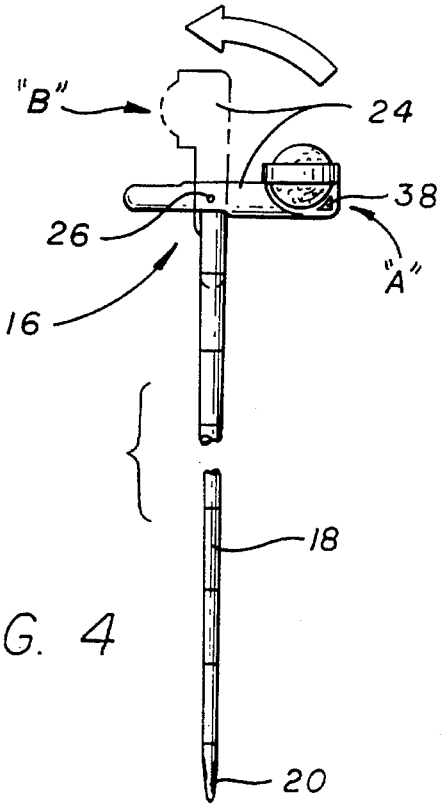
FIG. 4

GOLFER'S ACCESSORY

BACKGROUND OF THE INVENTION

1. Field of the Invention

The present invention relates to golf accessories, and, more particularly, to accessories for supporting an extra golf club in an upright position and for keeping an extra golf club dry and clean, and for conveniently transporting desired items to a location remote from a golf bag.

2. Description of the Related Art

For many years, golfers have resorted to casting extra golf clubs on the ground whenever more than one club had been carried away from the bag to play a remote shot. For example, golfers often grab a chipping club and a putter, and cast the putter on the ground while chipping, and cast the chipping club on the ground while putting. This leads to soiled or wet grips, and lost or forgotten clubs. Another situation is where the golfer grabs several clubs from a parked golf cart, not knowing which club is needed to play the remote shot. The need to grab extra golf clubs is often most felt when it is raining or when the ground is wet. Golfers also generally feel the need to have relatively dry grips, free of soil or grass, when the conditions are wet or humid. The problem is compounded by the fact that carts are not allowed on very wet fairways, so that extra golf clubs are often not available from a closely parked golf cart under wet conditions.

Some golfers have tried to combat this problem by propping the grip of an extra club on a golf tee inserted into the ground. This requires the golfer to bend down twice, and may not provide the needed height in rough areas having high grass. The club is not in a conspicuous position when propped on a tee, it is for all purposes in a horizontal position. It is not uncommon for extra clubs to be left behind when they are left in the horizontal position. Rain is more likely to soak the grips thoroughly when the club is substantially horizontal, such as propped on a tee or lying on the ground.

A device currently being sold is the "CADDY II", by Par 3 Enterprises, of Jacksonville, Fla. The device comprises a plastic tube having a cylindrical opening suitable for receiving the grip end of a golf club shaft. The plastic tube is closed off on a bottom portion and has a relatively large diameter metal stake affixed to the bottom of the tube. Near the top of the tube a plastic semicircular hook is provided. The device is inserted in a golf bag, stake portion down, and a club, such as a putter, may be inserted upside-down in the cylindrical opening. The stake portion of the device can be inserted into the ground, and the device can then support extra clubs by leaning them against the hook or by placing them upside down in the cylindrical opening.

This device has several drawbacks. The device takes up a large amount of space in a golf bag, and the hook portion is mounted in a fixed position, it sticks out a considerable amount. Only one club can be inserted in the cylindrical opening, usually the putter, but the putter is not always the extra club needed. In that case, the putter would probably be carried with the device to a remote shot location, along with any other extra clubs. Rain, condensation, and other debris are likely to collect in the cylindrical opening, especially near the bottom, where the extra club grip is located. Especially in heavy rain, the grip of a putter or other club inserted upside down is likely to get very wet.

The stake portion of the device is relatively thick. There is no handle to aid in inserting or removing the device from the ground. One must grasp either the plastic tube, which will be slippery when wet, or the hook, which may break or bend, to insert or remove the device. In areas where the ground is very hard, such as parts of the Northeast United States, for example, the large stake diameter will make the device difficult, if not impossible, to use, especially during the dry seasons on hard-packed ground. The large stake portion may also damage some golf courses unnecessarily. Apparently, the device makes no provision for conveniently transporting a towel, ball, or other desired equipment, such as a water resistant grip cover, to a remote shot location.

Accordingly, there has been a long felt and presently unsolved need to provide a device for supporting an extra golf club in a substantially upright position, allowing for compact and easy storage in a golf bag and for ease of transportation and use at a shot location remote from the golf bag. Additionally, the need to provide for convenient transportation, storage, and use of other items at a remote shot location has not been solved.

SUMMARY OF THE INVENTION

An extra golf club supporter operatively supports a golf club in a substantially upright position. The club supporter is conveniently inserted into the ground using a rotatable handle so that a golfer can keep an extra golf club relatively clean and dry, and so that the golfer does not have to bend down to pick up extra clubs off of the ground. The club supporter also helps minimize or eliminate the occurrence of lost or forgotten clubs, since it supports the extra club in a highly visible upright position. The club supporter also provides for the convenient storage of an extra golf ball, and for the handy positioning of a golf towel or other desired objects, such as tees or repair devices, when the golfer is away from the golf bag. The extra golf club supporter stores conveniently in a golf bag when not in use, taking up approximately the same space as an individual golf club. The present club supporter includes a rotatable handle assembly to make both storage and use of the club supporter convenient and desirable. The handle rotates approximately 90 degrees with respect to a shaft to an operative position "A" to allow convenient insertion into the ground and removal from the ground. A recess, clip, or receptacle portion receives an extra golf club shaft when the supporter is in the operative position. The handle and receptacle portion are out of the way during storage of the club supporter. The handle rotates back approximately 90 degrees to be aligned with the shaft in a storage position "B" to allow for convenient storage in a golf bag. The club supporter takes up relatively minimal space in the golf bag, and is conveniently and advantageously utilized with any combination of selected clubs.

A water repellent sleeve, or grip cover is preferably removably attached to the club supporter for covering extra club grips in especially wet weather. A water repellent towel rack, or cover, may also be removably attached to the club supporter in very wet weather so that a relatively dry towel will be close at hand for drying or cleaning grips, hands, or other objects. The towel rack or cover also provides for isolation between a relatively soiled towel, or towel portion, and a relatively clean towel, or towel portion.

DESCRIPTION OF THE DRAWINGS

FIG. I illustrates an extra club supporter operatively supporting an extra golf club;

FIG. 2 illustrates an extra club supporter conveniently stored in a golf bag;

FIG. 3 illustrates a front view of an extra club supporter;

FIG. 4 illustrates a side view of an extra club supporter, showing an operative and an inoperative position of the device.

DETAILED DESCRIPTION OF THE INVENTION

As illustrated in FIG. 1, an extra golf club supporter 10 operatively supports a golf club 14 in a substantially upright position. The club supporter 10 is conveniently inserted into the ground so that a golfer can keep an extra golf club 14 relatively clean and dry, and so that the golfer does not have to bend down to pick up extra clubs off of the ground. The club supporter also helps minimize or eliminate the occurrence of lost or forgotten clubs, since it supports the extra club 14 in a highly visible upright position. The club supporter 10 also provides for the convenient storage of an extra golf ball 42, and for the handy positioning of a golf towel 40 or other desired objects, such as tees or repair devices, when the golfer is away from the golf bag 12. As illustrated in FIG. 2, an extra golf club supporter 10 stores conveniently in a golf bag 12 when not in use, taking up approximately the same space as an individual golf club 14. The present club supporter 10 includes rotatable handle assembly 16 to make both storage and use of the club supporter 10 convenient and desirable. The handle 24 rotates approximately 90 degrees with respect to shaft 18 to an operative position "A" (FIGS. 1 and 4) to allow convenient insertion into the ground and removal from the ground. The handle 24 rotates back approximately 90 degrees to be aligned with shaft 18 in a storage position "B" (FIGS. 2 and 3) to allow for convenient storage in a golf bag 12. The club supporter 10 takes up relatively minimal space in the golf bag 12, and is conveniently and advantageously used with any combination of selected clubs 14.

As illustrated in FIG. 3, club supporter 10, shown in storage position "B", comprises shaft 18 having insert portion 20 disposed at a bottom end of the shaft 18 and having rotatable handle assembly 16 disposed at a top end of the shaft 18. An insert guard (not shown) may optionally be spring mounted to protect and cover the end of insert portion 20 when the club supporter 10 is being stored in golf bag 12, or is otherwise not in operation. Rotatable handle assembly 16 preferably comprises a plastic cylindrically-shaped handle 24 rotatably mounted to shaft 18 on pivot member 26. Handle 24 may be shaped to form a recess, clip, or receptacle 28, or a plurality of recesses, for receiving a portion of a golf club shaft allowing the golf club to be supported when the club supporter 10 is operatively inserted in the ground. It is contemplated that handle 24 may be provided as colorful or decorative plastic, and, additionally, may incorporate inherently distinctive aesthetic features as well.

Shaft 18 preferably comprises metal, composite, or plastic material, preferably such as an ordinary golf club shaft. For example, it is contemplated that golf club shafts having minor manufacturing defects, which would otherwise be unsuitable to make golf clubs, could be used as shaft 18, such as minorly defective metal or composite shafts. Alternatively, shaft 18 may comprise decorative plastic, or other material, such as a composite, and may additionally be either hollow or solid. Pivot member 26 may comprise a rivet, bolt, or other fastener allowing handle 24 to be rotatably, or pivotally mounted to shaft 18.

Insert portion 20 similarly comprises suitable rigid material, such as metal or plastic, and is preferably a thin steel rod having a diameter in the range of 1/16" to 3/8". However, other diameters could be used. The bottom end of insert portion 20 is preferably rounded at the edges, but alternatively may be beveled at the edges. In one aspect, as illustrated in FIG. 3, insert portion 20 is fixed to the bottom of shaft 18, and a retractable insert guard is provided (not shown). This facilitates the use of a relatively small diameter stake, or rod, as insert portion 20, which provides for convenient use in even hard ground or where insertion damage is desired to be minimal.

As illustrated in FIGS. 1 and 2, in still further aspects the club supporter 10 provides for the convenient and desirable storage of an extra golf ball 42 and an object such as golf towel 40 when the golfer is away from golf bag 12. These aspects allow the golfer to avoid the possible annoyance of storing extra golf balls in pockets, or the annoyance of having to carry a towel away from the bag. Many golfers will find added convenience and utility of having a towel handy, nearby, and yet not in the way when making a shot. Accordingly, an extra ball cup 37 and an accessory ring 38 are optionally provided on handle 24, formed of plastic, metal, or suitable material. It would be evident from the present disclosure that other desirable objects, such as tees, spike tightening tools, or grooming tools, could also be stored conveniently on extra club supporter 10 in similar fashion, by providing appropriate rings or clips.

Although the present invention is described with respect to particular embodiments, those of ordinary skill in the art would appreciate from a reading of the present disclosure that numerous variations or alternative embodiments of the invention are possible. Accordingly, the invention should not be considered as being limited to any particular embodiment described above, but should be construed according to the following claims.

What is claimed is:

1. A support device for holding a golf club substantially upright, said golf club including a shaft portion, comprising:

a support shaft having a top end and a ground insert portion disposed at a bottom end thereof;

a handle including a receptacle region provided thereon; and a pivot member engaging said shaft and said handle, said handle being rotatably mounted on said shaft by said pivot member substantially at said top end of said shaft;

said handle being rotatable between a storage position substantially aligned with said shaft thereby facilitating compact storage in a golf bag, and an operative position substantially at a right angle to said shaft, wherein said receptacle region receives a portion of said golf club shaft thereby supporting said golf club in a substantially upright position when said insert portion is inserted into the ground.

2. A support device as claimed in claim 1, in which said handle further includes a ball cup provided thereon for holding an extra golf ball, and also further includes an accessory ring provided thereon for attaching a towel thereto.

3. A support device as claimed in claim 1, in which said handle further includes a ball cup provided thereon substantially at said upper end thereof for holding an extra golf ball, and also further includes an accessory ring provided thereon for attaching a towel thereto.

4. A support device for holding a golf club substantially upright, said golf club including a shaft portion, comprising:

a support shaft comprising a golf club shaft having a top end and a bottom end;

a ground insert portion secured at said bottom end of said golf club shaft;

a cylindrically-shaped handle having an upper end thereof and including a receptacle region provided substantially at a lower end of said handle; and a pivot member engaging said support shaft and said handle, said handle being rotatably mounted on said support shaft by said pivot member substantially at said top end of said shaft, said receptacle region of said handle being disposed on a first side of said pivot member and said upper end of said handle disposed on a second side of said pivot member;

said handle being alternatively rotatable between a storage position substantially aligned with said shaft, wherein said receptacle region substantially aligns with said shaft below said pivot member and said upper end of said handle substantially aligns with said shaft above said pivot member, thereby facilitating compact storage in a golf bag, and an operative position substantially at a right angle to said shaft, wherein said receptacle region receives a portion of said golf club shaft thereby supporting said club in a substantially upright position when said insert portion is inserted into the ground.

* * * * *